United States Patent [19]

Ahluwalia

[11] Patent Number: 5,032,224

[45] Date of Patent: Jul. 16, 1991

[54] METHOD OF PRODUCING PULP

[75] Inventor: Madhu R. Ahluwalia, Mundelein, Ill.

[73] Assignee: Exxon Chemical Patent Inc., Linden, N.J.

[21] Appl. No.: 328,678

[22] Filed: Mar. 27, 1989

[51] Int. Cl.[5] ..... D21C 3/20

[52] U.S. Cl. ..... 162/75; 162/72; 162/76; 162/82

[58] Field of Search ..... 162/72, 75, 76, 82

[56] References Cited

U.S. PATENT DOCUMENTS

| | | | |
|---|---|---|---|
| 2,218,479 | 10/1940 | Peterson | 162/72 X |
| 3,536,697 | 10/1970 | Kolosh et al. | 162/72 X |
| 3,909,345 | 9/1975 | Parker et al. | 162/72 |
| 4,106,979 | 8/1978 | Ruffini et al. | 162/76 X |
| 4,184,912 | 1/1980 | Payton | 162/72 |
| 4,347,100 | 8/1982 | Brucato | 162/72 X |
| 4,426,254 | 1/1984 | Wood et al. | 162/72 |
| 4,444,621 | 4/1984 | Lindahl | 162/78 X |
| 4,673,460 | 6/1987 | Raff | 162/75 |
| 4,799,995 | 1/1989 | Crump et al. | 162/76 |

*Primary Examiner*—David A. Simmons
*Assistant Examiner*—Thi Dang

[57] ABSTRACT

Alkaline pulping (such as Kraft) processes for various lignocellulosic materials, such as coniferous or disiduous wood chips, into pulp is improved by adding relatively small amounts of a digestive additive selected from the group consisting essentially of anionic surfactants, nonionic surfactants, and anionic/nonionic surfactant blends, such as sodium alpha-sulfo methyl laurate, cocodiethanolamide, butyl ethylenoxide-propylenoxide block copolymers, etc. to the alkaline cooking media to obtain pulps having a select Kappa number range with a reduction in pulp material reject percentage, a reduction of H-factor, a reduction of white liquor requirements and a reduction of cooking time period, relative to H-factor, reject percentages, white liquor requirements and digestion periods experienced in similar alkaline digestion processes without the inventive digestive additive.

19 Claims, No Drawings

METHOD OF PRODUCING PULP

BACKGROUND OF INVENTION

1. Field of the Invention

The invention relates to pulp production and somewhat more particularly to the process of preparing pulp from a lignocellulosic material, such as coniferous or deciduous wood.

2. Prior Art

Production of pulp from lignocellulosic materials is well known and may involve mechanical, chemical, and thermal processes, or a select combination of such processes to produce cellulosic fibers which can be manufactured into various products, for example, paper. Particularly economically attractive processes typically involve chemical pulping, semichemical pulping and/or chemi-thermomechanical pulping, due to relatively high pulp yields.

Typically, in chemical pulping processes, shredded or chipped lignocellulosic materials are subjected to chemical reagents that remove at least partially, as by dissolving, extracting, dispersing or the like, lignin, hemicellulose, gums, carbohydrates, fatty materials, etc., collectively referred to as "resins" from, for example, wood chips to release cellulose fibers during a digestion process. A presently dominant chemical pulping process in the U.S. and certain other regions of the world is a so-called Kraft process. In the Kraft or sulphate process, sodium hydroxide and sodium sulfite typically comprise the principal cooking or digestive chemicals, which when admixed with water are generally referred to as alkaline pulping liquor or white liquor. The alkaline reagents react with lignin and other resin molecules, breaking them into smaller segments whose sodium salts are soluble or dispersable in the cooking liquor.

In the Kraft pulping process, a select amount of, for example wood chips, which may be pre-treated with steam or water that may also include chemical reagents, are charged to a digester vessel, along with alkaline pulping liquor to attain a select chemical or liquid-to-wood ratio and this material charge is then subjected to controlled heat and pressure over a select period of time. Both batch and continuous digestion processes are known. In batch processes, the material charged may be held under select temperature/pressure condition for a calculated period of time to attain a desired pulp characteristic and then discharged or "blown" into a holding tank so as to yield a pre-calculated amount of pulp suitable for further processing, such as chemical and/or heat recovery, washing, further digestive-type processing, bleaching, etc. prior to, for example, paper manufacturing. In a continuous digestion process, the material charge is controllably moved through zones of select temperature/pressure to a regulated discharge point, (i.e., a valve) to continuously yield pulp having desired characteristics (i.e., reduced "resins" content, a select Kappa number or range, water drainability, etc.).

A primary object of a pulping or digestion process is to reduce the amount of "resins" present in pulp fibers without deleteriously affecting paper forming characteristics while maintaining an economically viable process and product (pulp) costs. An emphasis has been placed in pulping processes involving chemical means to provide chemical reagents compatible with the digestion conditions and cooking chemicals and which aid deresination. For example, U.S. Pat. No. 2,716,058 describes the use of ethoxylated phenols and tall oil as deresination agents. U.S. Pat. No. 2,999,045, on the other hand, describes the use of copolymers of polyethylenoxide and polypropylenoxide as deresination agents. Organic solvents, such as kerosene, methanol, etc. and various emulsifiers such as certain sulfonated fatty acids (see U.S. Pat. No. 4,673,400) and solubilizint agents, such as $C_{12}$ alpha-olefin sulfonates (see U.S. Pat. No. 4,426,254) have also been suggested as deresination agents. In addition, anthraquinione and certain derivatives thereof have been suggested as additives or catalysts useful in cooking liquors for deresination of lignocellulosic materials, see U.S. Pat. No. 4,012,280. However, these various additives, solvents, catalysts, etc. tend to exhibit various drawbacks, including high chemical costs, excessive processing time, incompatibility with typical alkaline processing parameters, etc.

It is therefore an object of the invention to provide an improved method of producing pulps, such as paperboard pulps, containerboard pulps, linerboard pulps, corrugated medium pulps, Kraft or sulphate market pulps, etc., by adding a digestion additive to alkaline pulping liquor in a pulping process to attain a reduced H-factor, reduced material rejects, reduced "fresh" pulping liquor requirements and reduced cooking or digestion time periods relative to heretofore practiced pulping processes.

Other objects, features and advantages of this invention will become more apparent from the detailed description that follows.

SUMMARY OF THE INVENTION

The invention provides an improved method of producing pulp from lignocellulosic material such as wood, straw, bagasse, etc., by subjecting such material to an alkaline pulping process wherein a cooking or digesting additive selected from the group consisting essentially of anionic surfactants, nonionic surfactants and anionic/nonionic surfactant blends is added to an alkaline pulping liquor in a pulping process whereby a reduction of white (alkaline) liquor requirements, a reduction in H-factor, a reduction in percentage of pulp material rejects, and a reduction in cooking or digestion time for a select Kappa number range is attained, relative to similar pulping processes without such digestive additives.

In accordance with the principles of the invention, the pulping or digestive additives are selected from the group comprising alpha-sulfo alkyl esters, alkaryl sulfonates (i.e., hydrotropes), alkyl sulfates, alkyl sulfosuccinates, alkanolamides, alkyl polyoxyalkylene glycol ethers and mixtures thereof. Preferably, the above salt additives are neutralized with monovalent and divalent cations and preferably are selected from the group consisting essentially of Na, K, $NH_4$ [including $(HOCH_2CH_2)_3NH$, $(HOCH_2CH_2)_2NH_2$, etc.] Ca, Ba, Mg and mixtures thereof.

In certain preferred embodiments of the invention, the amount of digestive additive added to alkaline pulping liquors ranges from about 0.001% up to about 10% by weight, based on a 100% total weight basis of dry pulp produced.

The inventive process is particularly useful in producing the Kraft or sulphate pulps, such as paperboard pulps, containerboard pulps, linerboard pulps, market pulps, etc. However, the principles of the invention may also be utilized to produce other grades or types of pulps, such as, for example, a so-called dissolving pulp, utilized in manufacture of rayon and derivatives thereof.

The inventive process is particularly useful in producing paperboard pulps having a Kappa number ranging from about 30 to about 110 via an alkaline pulping process with a reduction in H-factor, a reduction in pulp-yeilding material rejects, a reduction of fresh cooking liquor (white liquor) requirements and a reduction in cooking or digestion time period, relative to heretofore conventional paperboard pulping processes.

DESCRIPTION OF PREFERRED EMBODIMENTS

The invention provides an improved method of producing pulps from any available lignocellulosic material source, such as coniferous or deciduous wood, straw, bagasse, etc., or mixtures thereof by subjecting such material to a pulping process involving chemical means whereby a digestive additive is added to alkaline cooking or digestion liquors so as to provide a reduced white liquor requirement, a reduced H-factor, a reduced percentage of pulp material rejects, and a reduced cooking or digesting time period, yielding a more economical pulp, relative to heretofore available pulping processes.

In accordance with the principles of the invention, a digestive additive selected from the group consisting essentially of anionic surfactants, nonionic surfactants, and anionic/nonionic surfactant blends, is added to an alkaline cooking liquor whereby reduced processing parameters including reduced chemical requirements, reduced cooking and time periods, reduce H-factor, reduced material rejects and improved pulp yields are attainable.

In accordance with the principles of the invention, the pulping or digestive additives are selected from the group comprising alpha-sulfo alkyl esters, alkaryl sulfonates, alkyl sulfates, alkyl sulfosuccinates, alkanolamides, alkyl polyoxyalkylene glycol ethers and mixtures thereof. Preferably, the above anionic salt additives are neutralized with monovalent and/or divalent cations and preferably are selected from the group consisting essentially of Na, K, $NH_4$ [including $(HOCH_2CH_2)_3NH$, $(HOCH_2CH_2)_2NH_2$, and similar ammonium derivatives[, Ca, Ba, Mg and mixtures thereof.

Example of alpha-sulfo alkyl esters include moieties having the formula:

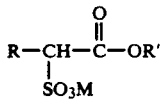

(I)

wherein R is an alkyl or alkenyl group containing from about 4 to about 18 carbon atoms; R' is an alkyl or alkenyl group containing from 1 to about 18 carbon atoms and M is a monovalent and/or divalent cation and preferably are selected from the group consisting essentially of Na, K, $NH_4$ [including $(HOCH_2CH_2)_3NH$, $(HOCH_2CH_2)_2NH$, etc.] Ca, Ba, Mg and mixture thereof.

Examples of alkaryl sufonates include moieties having the formula:

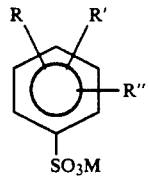

(II)

wherein R, R' and R'' are each independently selected from the group consisting of H, $C_1$–$C_{18}$ alkyl or alkylene groups and include linear and branched chain entities and M is a monovalent and/or a divalent cation and preferably is selected from the group consisting essentially of Na, K, $NH_4$ [including $(HOCH_2CH_2)_3NH$, $(HOCH_2CH_2)_2NH_2$, etc.] Ca, Ba, Mg and mixture thereof.

Examples of alkyl sulfates include moieties having the formula:

$$R—O—SO_3M \quad \text{(III)}$$

wherein R is a $C_4$ to $C_{18}$ alkyl or alkenyl groups and M is a monovalent and/or a divalent cation and preferably is selected from the group consisting essentially of Na, K, $NH_4$ [including $(HOCH_2CH_2)_3$ NH, $(HOCH_2CH_2)_2$ $NH_2$, etc.] Ca, Ba, Mg and mixture thereof.

Examples of alkyl sulfosuccinates include moieties having the formula:

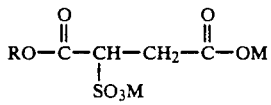

(IV)

wherein R is a $C_4$ to $C_{18}$ alkyl or alkenyl group and each M is independently a monovalent or divalent cation and is preferably selected from the group consisting essentially of Na, K, $NH_4$ [including $HOCH_2CH_2)_3$ NH, $(HOCH_2CH_2)_2$ $NH_2$, etc.] Ca, Ba, Mg and mixture thereof.

Examples of alkanolamides include moieties having the formula:

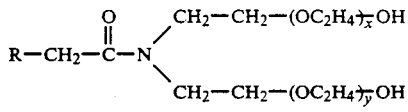

(V)

wherein R is a $C_4$ to $C_{18}$ alkyl or alkenyl group, and x and y are integers independently selected and ranging from 0 to about 6.

Examples of alkyl polyoxyalkylene glycol ethers include moieties having the formulas:

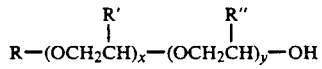

(VI)

wherein R is a $C_2$–$C_{18}$ alkyl or alkenyl group R' and R'' are H or $CH_3$ and are the same or different, and x and y are integers independently selected with a ratio of x:y ranging from about 1:1 to about 7:1, with the sum of x and y ranging from 0 to about 50.

The synthesis of the foregoing anionic and nonionic surfactants is well known and forms no portion of this invention.

The amount of digestive additive added in accordance with the principles of the invention to alkaline pulping liquor varies considerably and, principally for economical reasons, amounts up to about 10% by weight, based on the weight of pulp produced, may be added to alkaline pulping liquors. Preferably, the amount of digestive additive admixed with the alkaline pulping liquors ranges from about 0.001% up to about 10% by weight, based on a 100% total weight basis of dry pulp produced and more preferably ranges from about 0.01% up to about 5% by weight on the same basis. In typical pulp mill operations, the amount of digestive additives utilized is calculated on a pounds of chemical per ton of wood or other raw material utilized and under this system, the amount of digestive additives ranges from about 0.1 to 5 pounds per ton and more preferably from about 1 to 2 pounds per ton of wood.

The digestive additives of the invention are typically biodegradable and thus are environment compatible. Further, they may be considered relatively low foam generating materials or at least compatible with typical paper chemical defoamers, such as nonionic block copolymers available under the trade names PLURONICS® OR TETRONICS® and other like defoaming materials, i.e., silicon-based materials.

Thus, in accordance with the principles of the invention, the improved method of producing select pulps having a predetermined Kappa number or Kappa number range from a lignocellulosic material, such as coniferous or deciduous wood chips or mixtures thereof, comprises (a) feeding an amount of, preferably, substantially uniformly particulated lignocellulosic material to a digester capable of yielding a given amount of at least partially delignified cellulosic pulp, (b) adding a sufficient amount of an aqueous alkaline pulping liquor to the digester to substantially cover the lignocellulosic material therein (i.e., provide a select liquor-to-wood ratio), with the pulping liquor including therein an amount up to about 10% by weight, based on a 100% by weight basis of a dry weight amount of substantially delignified cellulosic pulp, of a digestive additive selected from the group consisting essentially of anionic surfactants, nonionic surfactants, and anionic/nonionic surfactant blends, so as to obtain an aqueous mixture of materials in the digester and subjecting such aqueous material mixture to select temperatures and pressures over select time periods so as to obtain a reduction of white liquor requirements, a reduction of H-factor, a reduction of material rejects and a reduction of digestion time, relative to white liquor requirements, H-factor, reject percentages and digestion times typically obtainable in similar alkaline digestion processes without the digestive additive, and (c) displacing the materials from the digester in such a manner as to attain at least some delignified cellulosic pulp and spent black pulping liquor (a portion of at least some chemicals therein may be recovered and/or a portion of such spent liquors may be recycled). As will be appreciated, in making up typical pulping liquor for a digestor, an operator may blend fresh alkaline liquor with spent or black liquor (or other recovered/recycled liquor) to obtain the economical benefits of reduced chemical costs but at some detriment to digestive action, unless the additives of the invention are utilized. With the principles of the invention, more black liquor may be utilized so that a reduction of white liquor requirements is readily achieved.

The principles of the invention are particularly useful in Kraft pulping procedures to produce Kraft or sulphate (market) pulps, as well as paperboard pulps, containerboard pulps, linerboard pulps, etc. However, the principles of the invention may also be utilized to produce other grades or types of pulp, such as, for example, a dissolving pulp utilized in the manufacture of rayon or a derivative thereof.

A pulp mill or pulp line or other lignocellulosic material processing facility typically seeks to produce a maximum amount of pulp at the lowest cost possible. Thus, a pulp mill typically adjusts a variety of chemical/processing parameters in an attempt to achieve maximum throughput of select quality of pulp. Thus, for example, a pulp mill may elect to utilize a somewhat higher cost processing chemical if the cook time will be reduced while yielding a comparable quality pulp, i.e., the higher chemical cost is offset by the greater amount of pulp produced. Similarly the addition of a further or adjunctive chemical to more traditional cooking chemicals may reduce processing times and reduce material rejects so as to provide a greater overall pulp throughput such as tons per day (tpd) over a given period of time, or reduce energy requirements to obtain the same quality of pulp as before and thus providing a lower cost per unit of pulp. Thus, pulp mills seek to balance operating/output parameters, typically expressed as Kappa number (degree of delignification), percentage of pulp-yielding material rejects, cooking or digestion parameters (temperature, pressure, time, etc.), including reduction in white liquor requirements, reduction of H-factor (defined as the relative reaction rate between the cooking chemicals and the "resins" in the lignocellulosic material, graphically expressed as cooking time versus temperature). Improvements in any one or more of these and other variables can lead to either greater through-put in a pulp mill or a lower cost per unit of pulp.

By practicing the inventive method, a pulp mill can readily achieve a more economical operation by adding the digestive additives to a pulping process and reducing white or fresh cooking liquor requirements, reducing H-factor, reducing rejects and reducing cooking time while maintaining a desired Kappa or range. Of course, if desired, the Kappa number or range may be reduced from that typically attainable at a given digester while keeping the processing parameters (H-factor, cooking time, etc.) relatively constant.

Further, as will be appreciated, the adjunctive chemical additives of the invention have utility not only in the initial digestion process (whether such involves a single or multi-step digestion process) of lignocellulosic materials but also in further refining processes, as sometimes are utilized to produce cellulose materials having a high or higher alpha cellulose content, such as may be required to produce rayon or a derivative thereof.

The anionic surfactants, nonionic surfactants or anionic/nonionic surfactant blends utilized to produce pulps in accordance with the principles of the invention function in an manner not presently fully understood. It may be that these digestive additives provide aspects of surfactants/wetting agents/emulsifiers/dispersants/-penetrants/solubilizers, etc., to the pulping process and function via numerous mechanisms, including, for example, wetting the surface of, for example, wood chips to allow the cooking chemicals to more rapidly penetrate into the interior layers thereof, and diffuse throughout the capillaries therein, solubilizing or emulsifying the "resins" or lignin by-products, etc.

Specific presently preferred anionic surfactant materials useful in the practice of the invention comprise sodium alpha-sulfo methyl laurate, (which may include some alpha-sulfo ethyl laurate) for example as commercially available under the trade name ALPHA-STEP TM -ML40; sodium xylene sulfonate, for example as commercially available under the trade name STEPANATE ®-X; triethanolammonium lauryl sulfate, for example as commercially available under the trade name STEPANOL ®-WAT; diosodium lauryl sulfosuccinate, for example as commercially available under the trade name STEPAN ®-Mild SL3; further blends of various anionic surfactants may also be utilized, for example a 50%-50% or a 25%-75% blend of the aforesaid ALPHA-STEP TM and STEPANATE ® materials, or a 20%-80% blend of the aforesaid ALPHA-STEP TM and STEPANOL ® materials (all of the aforesaid commercially available materials may be obtained from Stepan Company, Northfield, Ill.).

Specific presently preferred nonionic surfactant materials useful in the practice of the invention comprise cocodiethanolamide, such as commercially available under trade name NINOL ®-11CM; alkyl polyoxyalkylene glycol ethers, such as relatively high molecular weight butyl ethylenoxide-propylenoxide block copolymers commercially available under the trade name TOXIMUL ®-8320 from the Stepan Company. Additional alkyl polyoxyalkylene glycol ethers may be selected, for example, as disclosed in U.S. Pat. No. 3,078,315. Blends of the various nonionic surfactants may also be utilized, for example a 50%-50% or a 25%-75% blend of the aforesaid NINOL ® and TOXIMUL ® materials.

Specific presently preferred anionic/nonionic surfactant blends useful in the practice of the invention include various mixtures of the above materials, for example a 50%-50% blends of the aforesaid ALPHA-STEP TM and NINOL ® materials or a 25%-75% blend of the aforesaid STEPANATE ® and TOXIMUL ® materials.

Preferably, the various anionic, nonionic and anionic/nonionic surfactant blends utilized in the practice of the invention have a solids or actives content up to about 100% by weight and preferably have an active content ranging from about 10% to about 80%. Of course, other blends or other solids (active) content may also be utilized and these anionic surfactants, nonionic surfactants, and mixtures thereof may also be utilized with known pulping chemicals such as, for example, anthraquinone and derivatives thereof and/or other typical paper chemicals, such as caustics, defoamers and the like.

The digestive additives of the invention are readily soluble in hot and cold aqueous solutions and are stable at typical digestion parameters, i.e. at typical digestion temperatures ranging from about 120° to about 180° C., typical digestive time periods typically ranging from about 15 minutes to about 4 hours or more, typical digestive pressures ranging up to about 5 to 10 kg/cm$^2$, and typical cooking liquor pH levels up to about 13 or more. Further, unlike anthraquinone, the digestive additives of the inventions are readily soluble in aqueous solutions and may thus be sprayed or the like onto wood chips prior to charging the same into a digester.

With the foregoing general discussion in mind, a number of detailed examples are presented which will illustrate to those skilled in the art, the manner in which the invention is carried out. However, these examples are not to be construed as limiting the scope of the invention in any way but are provided merely to point out the efficacy of the invention in attaining exemplary economical pulping production and to demonstrate a preferred utility of the digestive additives of the invention.

EXAMPLE

The pulping conditions utilized and the residual liquor analysis data are set forth in Table 1 below. All pulping runs were carried out in uniform size laboratory digesters. In each run, 2,000 grams of O.D. (oven dry) soft wood (southern pine) chips passing through a ¾ inch screen and retained on a ¼ inch screen were charged into the digester and white liquor containing a select digestive additive in specified amounts was added to a digester to attain a select liquor-to-wood ratio. The liquor was continuously circulated during each entire cooking cycle, which was made using indirect steam.

Constant pulping conditions were adopted for each run and were as follows: liquor-to-wood ratio=4:1; time period to rise to cooking temperature=15 minutes; cooking temperature=340° F. (about 171° C.); time period at cooking temperature=65 minutes. At the end of each cooking cycle, the cooks were blown at 90 psig (about 6 kg/cm$^2$) and subsequently washed with ambient temperature water, until substantially free of chemicals. After washing, the pulps were defiberized in a laboratory refiner in one pass at 0.25 inch clearance with a continuous flow of water. The pulps were screened on a 10-cut screen after defiberization. The pulps from each cook were subjected to screened Kappa numbers, percent rejects, yields and residual liquor analysis.

TABLE I

SUMMARY OF ALKALINE COOKING DATA

| | COOK NO. | | | | | | | |
|---|---|---|---|---|---|---|---|---|
| *Additive | 1 Control | 2 ALPHA-STEP NINOL-11CM 50/50 BLEND | 3 TOXIMUL 8320 | 4 STEPAN-ATE-X | 5 STEPANOL WAT | 6 STEPAN MILD SL3 | 7 ALPHA-STEP | 8 ANTHARA-QUINONE |
| Conditions: | | | | | | | | |
| Chip Moisture, % | 51.1 | 51.1 | 51.1 | 51.1 | 51.1 | 51.1 | 51.1 | 51.1 |
| Liquor:Wood Ratio | 4:1 | 4:1 | 4:1 | 4:1 | 4:1 | 4:1 | 4:1 | 4:1 |
| Chip Charge, O.D., grams | 2000 | 2000 | 2000 | 2000 | 2000 | 2000 | 2000 | 2000 |
| Total Liquid, ml | 8000 | 8000 | 8000 | 8000 | 8000 | 8000 | 8000 | 8000 |
| Time Up, min. | 15 | 15 | 15 | 15 | 15 | 15 | 15 | 15 |
| Time At, min. | 65 | 65 | 65 | 65 | 65 | 65 | 65 | 65 |
| Temperature, °F. | 340 | 340 | 340 | 340 | 340 | 340 | 340 | 340 |
| Pressure, psig | 90 | 90 | 90 | 90 | 90 | 90 | 90 | 90 |

TABLE I-continued

| SUMMARY OF ALKALINE COOKING DATA | | | | | | | | |
|---|---|---|---|---|---|---|---|---|
| Chemicals: | | | | | | | | |
| White Liquor, grams AA | 300 | 300 | 300 | 300 | 300 | 300 | 300 | 300 |
| **Active Alkali, % | 15 | 15 | 15 | 15 | 15 | 15 | 15 | 15 |
| Sulfidity, % | 25 | 25 | 25 | 25 | 25 | 25 | 25 | 25 |
| Additive, lbs./ton on O.D. Wood | 0 | 2 | 2 | 2 | 2 | 2 | 2 | 1.34 |
| | COOK NO. | | | | | | | |
| *Additive | 1 Control | 2 ALPHA-STEP NINOL-11CM 50/50 BLEND | 3 TOXIMUL 8320 | 4 STEPAN-ATE-X | 5 STEPAN WAT | 6 STEP-ANOL MILD SL3 | 7 ALPHA-STEP ML40 | 8 ANTHARA-QUINONE |
| Residual Liquor: | | | | | | | | |
| *Active Alkali, g/l | 13.64 | 15.19 | 13.64 | 14.57 | 16.43 | 15.81 | 16.59 | 14.88 |
| **Effective, Alkali, g/l | 7.13 | 8.37 | 7.13 | 7.75 | 8.06 | 8.37 | 8.53 | 6.51 |
| pH | 12.8 | 13.1 | 13.0 | 13.0 | 13.0 | 13.0 | 12.7 | 12.45 |
| Pulp Results: | | | | | | | | |
| Total Yield, % | 55.2 | 54.0 | 54.4 | 54.5 | 53.8 | 53.7 | 53.9 | 56.6 |
| Screened Yield, % | 50.1 | 50.5 | 50.1 | 51.1 | 49.7 | 49.7 | 49.8 | 52.6 |
| Screened Kappa Number | 77.0 | 62.4 | 69.1 | 69.2 | 66.5 | 66.7 | 70.4 | 68.4 |
| Rejects, % | 9.2 | 6.5 | 7.9 | 6.3 | 7.2 | 7.4 | 7.6 | 7.0 |

*Trademark materials identified earlier herein.
**Active and effective alkali concentrations are expressed as $Na_2O$.

As shown by the above data, the digestive additives of the invention provide beneficial results in comparison to a typical alkaline pulping (control) run or cycle and in comparison to anthraquinone. Thus, under substantially uniform pulping conditions, all of the exemplary inventive additives tested in the above Example provided lower Kappa numbers in comparison to the control, similar or lower rejects as anthraquinone (and, of course, substantially lower than the control), and greater total pulp yield to that of the control and similar to that attained with anthraquinone. Further, it is pointed out that anthraquinone is difficult to work with due to its relative insolubility and this material is relatively expensive, being about 2.5 to 5 times more expensive than the inventive additives. Yet further, in instances where a pulp mill seeks to produce a pulp having a given Kappa number or Kappa number range, and elects to utilize the digestive additives of the invention, a substantial reduction in H-factor (graphical relation between cook time versus temperature), a reduction in alkaline (fresh) liquor requirements, a reduction of reject percentage and a reduction of cook times can be attained at a very low additional cost.

As is apparent by the foregoing specification, the present invention is susceptible of being embodied with various alterations and modifications which may differ particularly from those that have been described in preceding specification and description. For this reason, it is to be fully understood all of the foregoing is intended to be merely illustrative and is not to be construed or interpreted as being restrictive or otherwise limiting of the present invention, excepting as set forth in the hereto appended claims.

I claim:

1. In a method of preparing pulp from a lignocellulosic material by subjecting said material to an alkaline pulping liquor at a select temperature, pressure and time period to attain a pulp having a select Kappa number range, the improvement comprising:

(a) adding an amount up to about 10% by weight, based on a 100% weight basis of dry pulp being produced, of a digestive additive selected from the group consisting of alphasulfo alkyl esters, alkaryl sulfonates, alkanolamides, and mixtures thereof to said alkaline pulping liquor whereby a reduction of alkaline pulping liquor requirements, a reduction of H-factor, a reduction in material reject percentages, and a reduction in cooking time period is attained;

(b) discharging said pulping liquors and the at least partially delignified lignocellulosic material to attain a pulp slurry; and (c) displacing said pulping liquor from said partially delignified lignocellulosic material with water or an aqueous liquor to attain a pulp having said select Kappa number range.

2. In a method as defined in claim 1 wherein said digestive additive is selected from the group consisting of alphasulfo alkyl esters, alkaryl sulfonates, and which are neutralized with a monovalent and/or divalent cation selected from the group consisting of an alkaline metal, alkaline earth metal, ammonium, substituted ammonium, and mixtures thereof.

3. In a method as defined claim 2 wherein the cation is selected from the group consisting of Na, K, Ca, Ba, Mg, $NH_4$, $(HOCH_2CH_2)_3NH$, $(HOCH_2CH_2)_2NH_2$, and mixtures thereof.

4. In a method as defined in 2 wherein said alphasulfo alkyl ester is an alkyl sulfosuccinate.

5. In a method as defined in claim 3 wherein said digestive additive is sodium alpha-sulfo methyl laurate.

6. In a method as defined in claim 3 wherein said digestive additive is sodium xylene sulfonate.

7. In a method as defined in claim 3 wherein said digestive additive is triethanolammonium lauryl sulfate.

8. In a method as defined in claim 3 wherein said digestive additive is disodium lauryl sulfosuccinate.

9. In a method as defined in claim 3 wherein said digestive additive is an alkanolamide.

10. In a method as defined in claim 9 wherein said alkanolamide is cocodiethanolamide.

11. In a method as defined in claim 3 wherein said digestive additive is a blend of sodium alpha-sulfo methyl laurate and cocodiethanolamide.

12. In a method as defined in claim 1 wherein the amount of said digestive additive added to said alkaline pulping liquor ranges from about 0.001% to about 5.0% by weight, based on a 100% total weight basis of dry pulp being produced.

13. In a method of preparing Kraft pulp from a lignocellulosic material by subjecting said materials to a Kraft pulping liquor at a selected temperature, pressure and time period to attain a pulp having a select Kappa number range, the improvement comprising:

(a) adding an amount up to about 10% by weight, based on a 100% total weight basis of dry pulp being produced, of a digestive additive selected from the group consisting of alpha-sulfo alkyl esters, alkaryl sulfonates, alkyl sulfates, alkanolamides, and mixtures thereof to said Kraft pulping liquor whereby a reduction of pulping liquor requirements, a reduction of H-factor, a reduction in material reject percentages and a reduction in cooking time period is attained, relative to pulping liquor requirements, H-factor reject percentages and digestion time period experienced in similar Kraft pulping processes without said digestive additives;

(b) discharging said pulping liquor and the at least partially lignocellulosic material to attain a pulp slurry; and (c) displacing said pulping liquor from said pulp slurry with water or an aqueous liquor to attain a Kraft pulp having a select Kappa number range.

14. In a method as defined in claim 13 wherein said alpha-sulfo alkyl esters, alkaryl sulfonates, and alkyl sulfonates are neutralized with a monovalent and/or divalent cation selected from the group consisting of an alkaline metal, alkaline earth metal, ammonium, substituted ammonium, and mixtures thereof.

15. In a method as defined in 13 wherein said alpha-sulfo alkyl ester is an alkyl sulfosuccinate.

16. In a method as defined claim 14 wherein the cation is selected from the group consisting of Na, K, Ca, Ba, Mg, $NH_4$, $(HOCH_2CH_2)_3NH$, $(HOCH_2CH_2)_2NH_2$, and mixtures thereof.

17. In a method as defined in claim 13 wherein the amount of said digestive additive added to said alkaline pulping liquor ranges from about 0.001% to about 5.0% by weight, based on a 100% total weight basis of dry pulp being produced.

18. A method of producing a paperboard pulp having a Kappa number in the range of about 30 to about 110 from a lignocellulosic material comprising:

(a) feeding an amount of said lignocellulosic material to a digester capable of yielding a given amount of paperboard pulp;

(b) adding a sufficient amount of an alkaline pulping liquor to said digester to attain a select liquor-to lignocellulosic material ratio therein, said pulping liquor including therein an amount up to about 10%, based on a 100% total weight basis of dry paperboard pulp being produced, of a digestive additive selected from the consisting of sodium alpha-sulfo methyl laurate, sodium xylene sulfonate, triethanolammonium lauryl sulfate, disodium lauryl sulfosuccinate, cocodiethanolamide, and mixtures thereof, to attain an aqueous mixture of materials in said digester and subjecting said mixture to elevated temperatures and pressures over selected time periods so as to attain a reduction of pulping liquor requirements, a reduction of H-factor, a reduction of pulp material rejects and a reduction in digestion time, relative to pulping liquor requirements, H-factor, reject percentages and digestion time periods experienced in similar alkaline digestion processes without said digestive additive; and (c) displacing said aqueous mixture of materials from said digester in such a manner as to attain at least some paperboard pulp and spent pulping liquor.

19. In a method as defined in claim 18 wherein the amount of said digestive additive added to said alkaline pulping liquor ranges from about 0.001% to about 5.0% by weight, based on a 100% total weight basis of dry pulp being produced.

* * * * *